US009494381B1

(12) United States Patent
Jeske

(10) Patent No.: US 9,494,381 B1
(45) Date of Patent: Nov. 15, 2016

(54) CROSSBOW DE-COCKING DEVICE AND METHOD

(71) Applicant: Richard Henry Jeske, Summit Lake, WI (US)

(72) Inventor: Richard Henry Jeske, Summit Lake, WI (US)

( * ) Notice: Subject to any disclaimer, the term of this patent is extended or adjusted under 35 U.S.C. 154(b) by 0 days.

(21) Appl. No.: 14/999,459

(22) Filed: May 9, 2016

Related U.S. Application Data

(60) Provisional application No. 62/179,785, filed on May 18, 2015.

(51) Int. Cl.
*F41B 5/18* (2006.01)
*F41B 5/12* (2006.01)
*F41B 5/14* (2006.01)

(52) U.S. Cl.
CPC ..... *F41B 5/1469* (2013.01); *F41B 5/12* (2013.01)

(58) Field of Classification Search
CPC ..... F41B 5/1469; F41B 5/123; F41B 5/12
USPC ..... 124/25, 35.2, 86
See application file for complete search history.

(56) References Cited

U.S. PATENT DOCUMENTS 3,670,711 A * 6/1972 Firestone ..... F41B 5/12 124/25
4,603,676 A * 8/1986 Luoma ..... F41B 5/1469 124/25
4,919,107 A * 4/1990 Bunts ..... F41B 5/14 124/24.1
5,220,906 A * 6/1993 Choma ..... F41B 5/12 124/25
5,823,172 A * 10/1998 Suggitt ..... F41B 5/12 124/25
6,012,440 A * 1/2000 Grindle ..... F41B 5/1469 124/35.2
6,286,496 B1 * 9/2001 Bednar ..... F41B 5/1469 124/25
6,499,478 B1 * 12/2002 Perez ..... F41B 5/14 124/25.6
6,799,566 B1 * 10/2004 Malucelli ..... F41B 5/12 124/25
7,017,568 B1 * 3/2006 Smith ..... F41B 5/1469 124/25
8,375,928 B1 2/2013 Bednar et al.
8,376,882 B2 * 2/2013 Shaffer ..... F41B 5/1469 124/25
8,439,026 B1 * 5/2013 Kilian ..... F41B 5/1469 124/35.2
8,578,917 B2 11/2013 Bednar et al.
8,671,923 B2 * 3/2014 Goff ..... F41B 5/123 124/25
8,752,535 B2 * 6/2014 Barber ..... F41B 5/12 124/25
9,303,944 B2 * 4/2016 Barber ..... F41B 5/123
9,341,432 B1 * 5/2016 Wohleb ..... F16H 25/20
2012/0152220 A1 * 6/2012 Barber ..... F41B 5/12 124/35.1
2014/0261360 A1 * 9/2014 Pulkrabek ..... F41B 5/1469 124/35.2
2014/0305417 A1 10/2014 Barber

* cited by examiner

*Primary Examiner* — Alexander Niconovich
(74) *Attorney, Agent, or Firm* — Timothy S. Stevens; Karen L. Kimble

(57) ABSTRACT

Apparatus and method for de-cocking a crossbow. The apparatus includes: (a) a body adapted to attach to a crossbow, the body having a channel therethrough and a threaded bore therethrough intersecting with the channel; (b) a notched wedge adapted to slide through the channel; and (c) a threaded stud so that when the wedge is slid through the channel and the threaded stud is threaded into the threaded bore, the stud can contact the wedge and halt further travel of the wedge through said body. When the body is attached to a cocked crossbow with the bowstring of the bow positioned in the notch of the wedge, the trigger of the crossbow can be pulled to release the bowstring against the wedge and the crossbow de-cocked by unscrewing the stud.

16 Claims, 11 Drawing Sheets

CROSSBOW DE-COCKING DEVICE AND METHOD

BACKGROUND OF THE INVENTION

The instant invention is in the field of crossbows and more specifically in the field of devices and methods for de-cocking a crossbow. The classic crossbow is cocked by hand and de-cocked by shooting a bolt from the crossbow since triggering a cocked crossbow without loading a bolt is likely to damage the crossbow. Shooting a bolt into the ground or into a tree to de-cock a crossbow is likely to damage the bolt. Shooting a bolt into the air to de-cock a crossbow is dangerous and is likely to result in a lost bolt. Devices have been invented for de-cocking a crossbow without shooting a bolt from the crossbow. For example, the CONCORDE crossbow by PARKER BOWS uses a $CO_2$ powered de-cocking system built into the crossbow. U.S. Pat. Nos. 6,286,496; 8,375,928; and 8,578,917 disclose an electric motor powered clockwork gear and clutch system to de-cock a crossbow. U.S. Pat. Nos. 5,220,906 and 6,799,566 disclose an electric motor powered jack screw system to de-cock a crossbow. US Patent Application Publication 2014/0305417 discloses a hydraulic cylinder system to dc-cock a crossbow. It would be an advance in the art of devices and methods for de-cocking a crossbow if a device were discovered that could be conveniently attached to a crossbow for dc-cocking the crossbow, which device was less obtrusive, less complicated and safer to use than the devices of the prior art.

SUMMARY OF THE INVENTION

The instant invention is an apparatus and method for de-cocking a crossbow. The apparatus of the instant invention is less obtrusive, less complicated and safer to use than the de-cocking devices and methods of the prior art. More specifically, the instant invention is an apparatus for de-cocking a crossbow comprising: (a) a body adapted to attach to a crossbow, the body comprising a channel therethrough, the body also comprising a threaded bore therethrough, the threaded bore intersecting with the channel; (b) a wedge adapted to slide through said channel, said wedge having a notch on a distal end thereof; (c) a threaded stud so that when said wedge is slid through said channel said threaded stud is threaded into said threaded bore, the distal end of said stud can contact said wedge and halt further travel of said wedge through said body, so that when the body is attached to a cocked crossbow with the bowstring of the bow positioned in the notch of the wedge with the distal end of the stud contacting the wedge, the trigger of the crossbow can then be pulled to release the bowstring against the wedge and then the threaded stud can be unscrewed to permit the wedge to controllably slide further through the channel to de-cock the crossbow.

The instant invention is also a method of de-cocking a cocked crossbow, comprising: (a) engaging the bowstring of a crossbow with a notch in the end of a wedge, the wedge being engaged in a channel of a body, the body comprising a threaded bore intersecting with said channel, a threaded stud being screwed into said threaded bore so that the end of said stud contacts said wedge in said channel; (b) attaching said body to said cocked crossbow; (c) releasing said bowstring against said notch; and (d) unscrewing said stud to permit the wedge to controllably slide further through said channel to de-cock said crossbow.

DETAILED DESCRIPTION OF THE INVENTION

Figure 1:
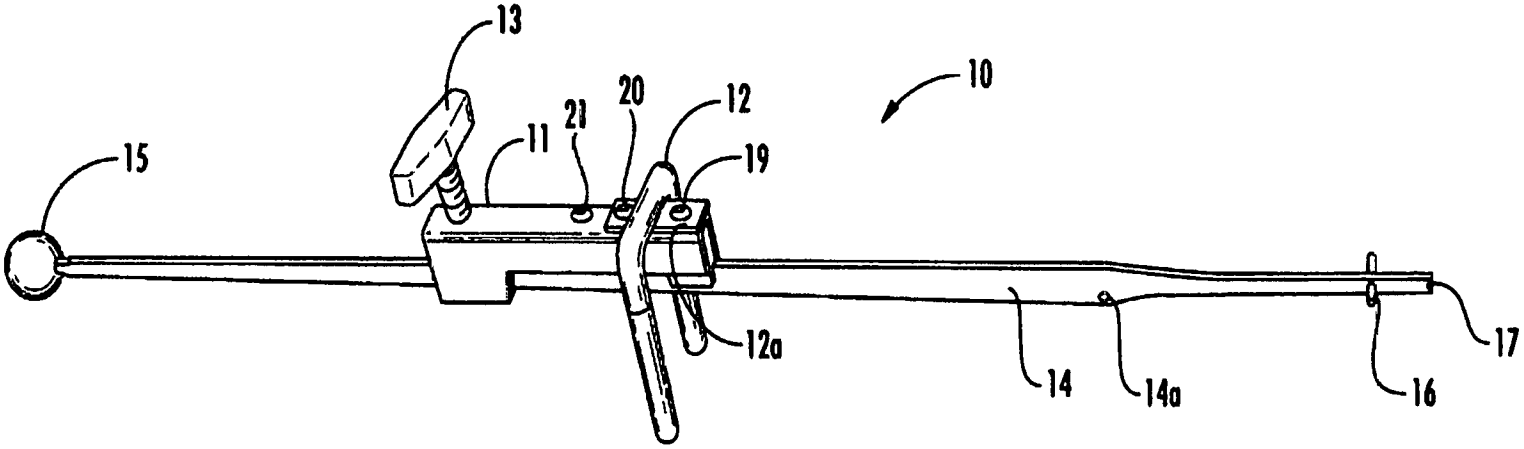
FIG. 1 is a perspective view of a preferred apparatus of the instant invention for de-cocking a crossbow, the apparatus including a body, a wedge and a handle.
Figure 2:
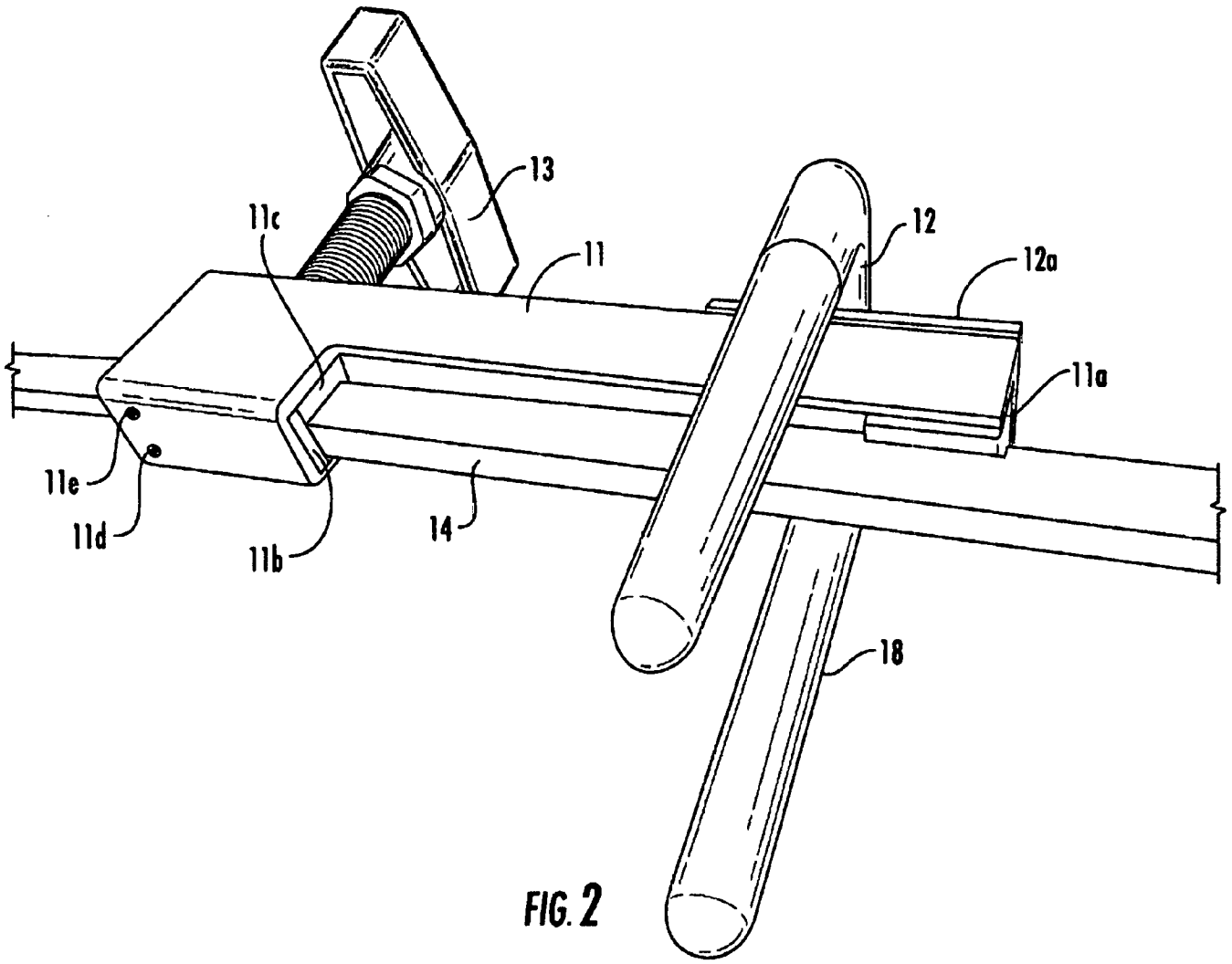
FIG. 2 is a perspective view of the underside of the body, wedge and handle shown in FIG. 1.
Figure 4:
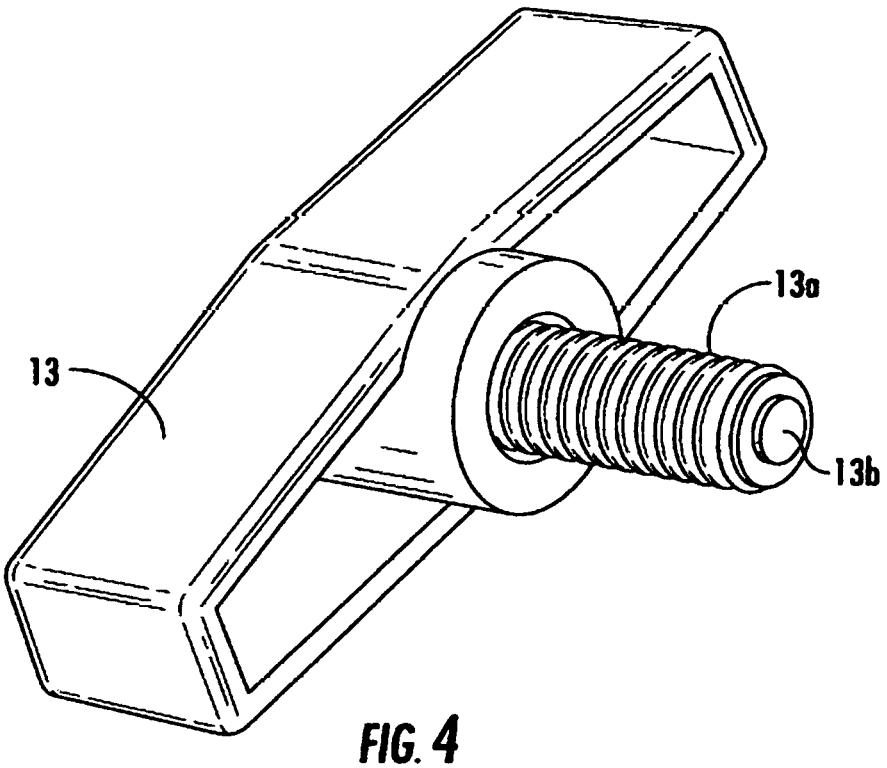
FIG. 4 is a perspective view of the handle shown in FIG. 1, the handle comprising a threaded stud.

Referring now to FIG. 1, therein is shown an perspective view of a preferred apparatus 10 of the instant invention for de-cocking a crossbow, the apparatus 10 including body 11 and wedge 14. Body 11 is adapted to attach to a crossbow as will be detailed below. Referring now to FIG. 2, therein is shown a perspective view of the underside of body 11. It will be noted that wedge 14 has been passed through (engaged with) a channel in body 11. Body 11 also comprises U-bolt 12 welded to plate 12*a*. U-bolt 12 welded to plate 12*a* so that the spaced apart legs of U-bolt 12 are parallel to each other and extend from body 11. The legs of U-bolt 12 are covered with plastic coating 18. Referring again to FIG. 1, plate 12*a* is attached to body 11 by round head bolts 19 and 20. Plate 12*a* can be re-positioned toward handle 13 by re-attaching plate 12*a* to body 11 using round head bolts 20 and 21 to adapt apparatus 10 to a wider range of different crossbows. Apparatus 10 comprises handle 13. Referring now to FIG. 4, handle 13 comprises a threaded stud 13*a*. A section of brass rod 13*b* is inserted into stud 13*a* so that rod 13*b* extends from stud 13*a* as shown in FIG. 4. Referring again to FIG. 1, threaded stud 13*a* is screwed into a threaded bore in body 11 which threaded bore intersects with the channel in the body so that when wedge 14 is slid through said channel the brass distal end of stud 13*a* can contact wedge 14 and halt further travel of wedge 14 through body 11. In use, the friction qualities of brass on the wedge at the top of the wedge 14, the friction qualities of the plastic insert 11*b* on the bottom of the wedge 14 and the friction qualities of the plastic inserts 11*a*, 11*b* and 11*c* on the sides of wedge 14 are all highly preferred as resulting in the smooth progression of the wedge 14 through the channel as a crossbow is de-cocked. The distal end of wedge 14 near the wider portion of the wedge is notched with notch 17 to receive the bowstring of a crossbow. Pin 16 is positioned though the wedge as shown to help guide wedge 14 on the barrel of a crossbow. Ball 15 is attached to the other end of wedge 14 as a handle for the wedge 14. Referring again to FIG. 2, plastic inserts 11*b* and 11*c* are attached to body 11 by screws 11*d* and 11*e*. Plastic insert 11*a* is attached to body 11 by bolt 19.

Figure 12:
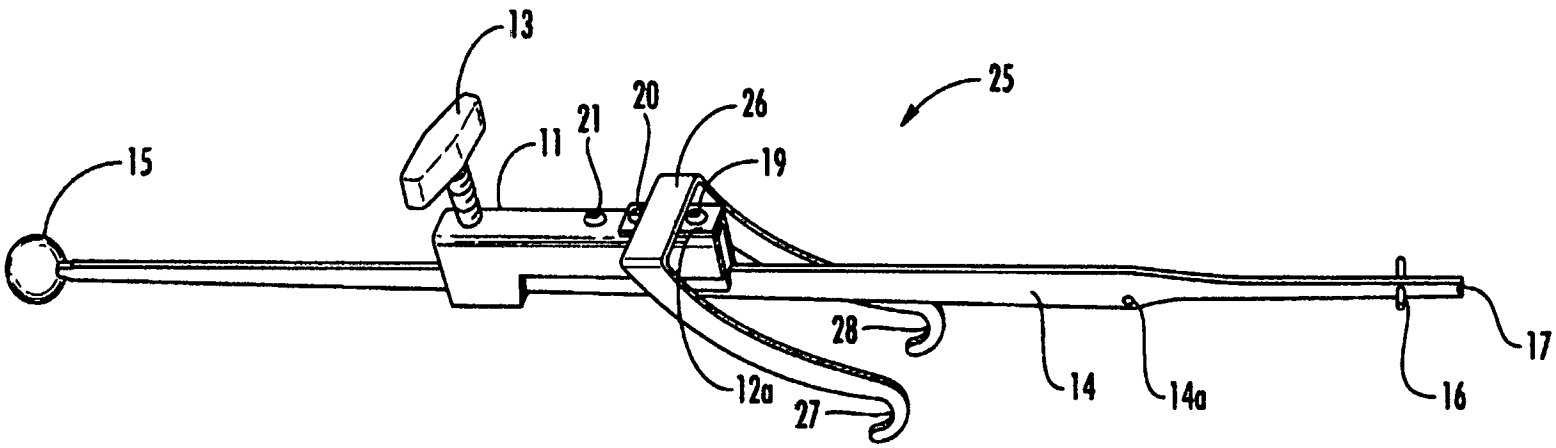
FIG. 12 is a perspective view of another preferred apparatus of the instant invention for de-cocking a reverse draw crossbow.

The preferred material of construction for the body 11, the plate 12*a* and the U-bolt 12 is steel coated with zinc and/or a paint coating. However, apparatus 10 could, of course, be made of any suitable material and could even be made by injection molding a thermoplastic polymer. The preferred material of construction for the handle 13 and ball 15 is plastic. The preferred material of construction for the wedge 14 is zinc coated steel. Pin 16 is preferably a steel roll pin. Thin plastic tubing (not shown) is preferably slipped onto the exposed ends of pin 16. Although U-bolt 12 and plate 12*a* are preferred as a means of attaching body 11 to a crossbow, body 11 can be attached to a crossbow by any suitable means such as bolts, clamps, screws, sockets, hooks (as shown in FIG. 12) or pins. The legs of U-bolt 12 are preferably not threaded.

Figure 3A:
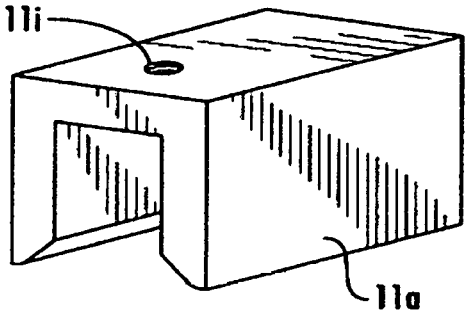
FIGS. 3*a*-3*d* are perspective views of inserts in the body shown in FIG. 2.
Figure 3B:
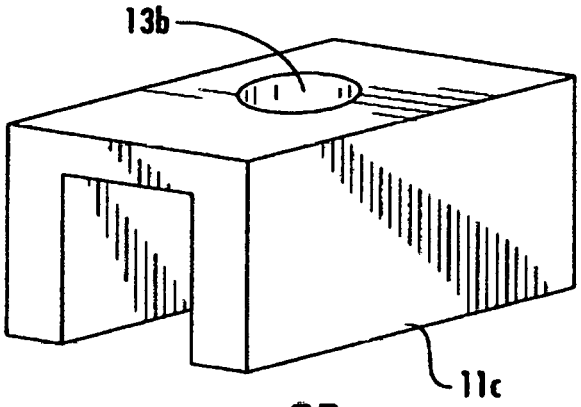
Figure 3C:
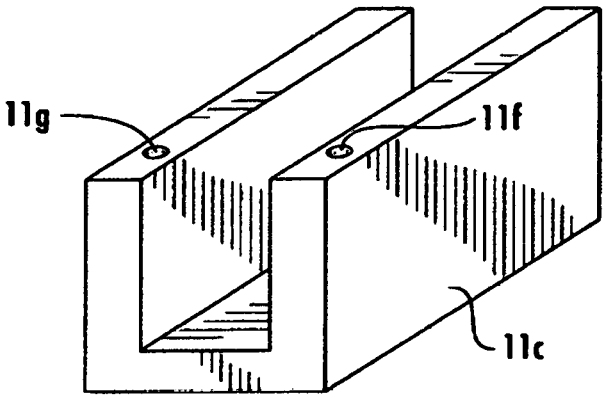
Figure 3D:
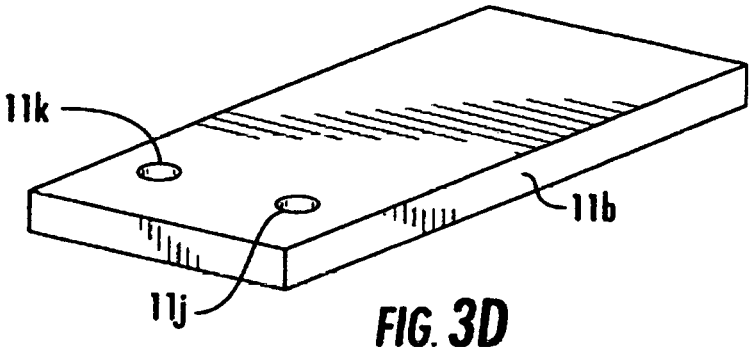

Referring now to FIG. 3D, therein is shown a perspective view of plastic insert 11*b* including holes 11*j* and 11*k* for the passage of screws 11*d* and 11*e*. Referring now to FIG. 3A, therein is shown a perspective view of plastic insert 11*a* including threaded hole 11*i* for bolt 19. Referring now to FIG. 3B and FIG. 3C, therein is shown top and bottom perspective views of plastic insert 11*c* including bore 13*b*. The diameter of bore 13*b* being somewhat larger than the diameter of threaded stud 13*a* so that threaded stud 13*a* can intersect with the channel through which the wedge of the instant invention is slid, which channel is defined in this embodiment by the slot in insert 11*c* and the exposed surface of insert 11*b*. Pilot holes 11*f* and 11*g* are provided to receive screws 11*d* and 11*e*.

Figure 5:
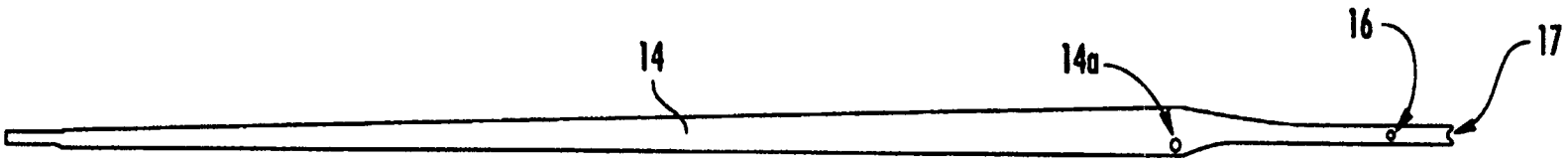
FIG. 5 is a side view of the wedge shown in FIG. 1.

Referring now to FIG. 5, therein is shown wedge 14 which is preferably about two feet long and 3/16 inch thick. Hole 14*a* is provided to attach an accessory. It will be noted that wedge 14 is somewhat asymmetrical about the longitudinal axis of the wedge from the notch 17 to the other end of wedge 14 so that wedge 14 can be inverted in body 11 to better adapt apparatus 10 to different crossbows.

Figure 6:
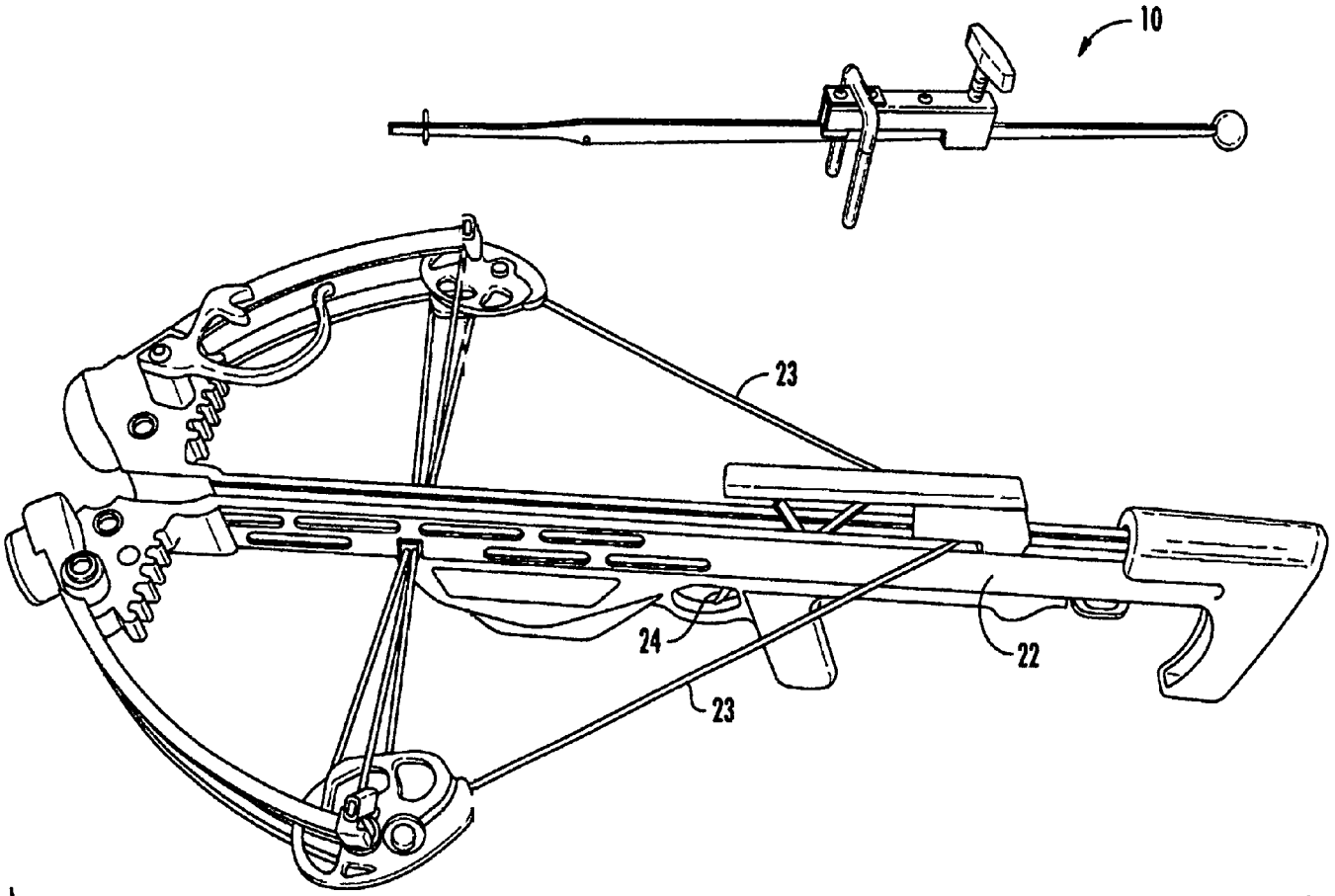
FIG. 6 is a perspective view of a cocked crossbow and the apparatus shown in FIG. 1.
Figure 7:
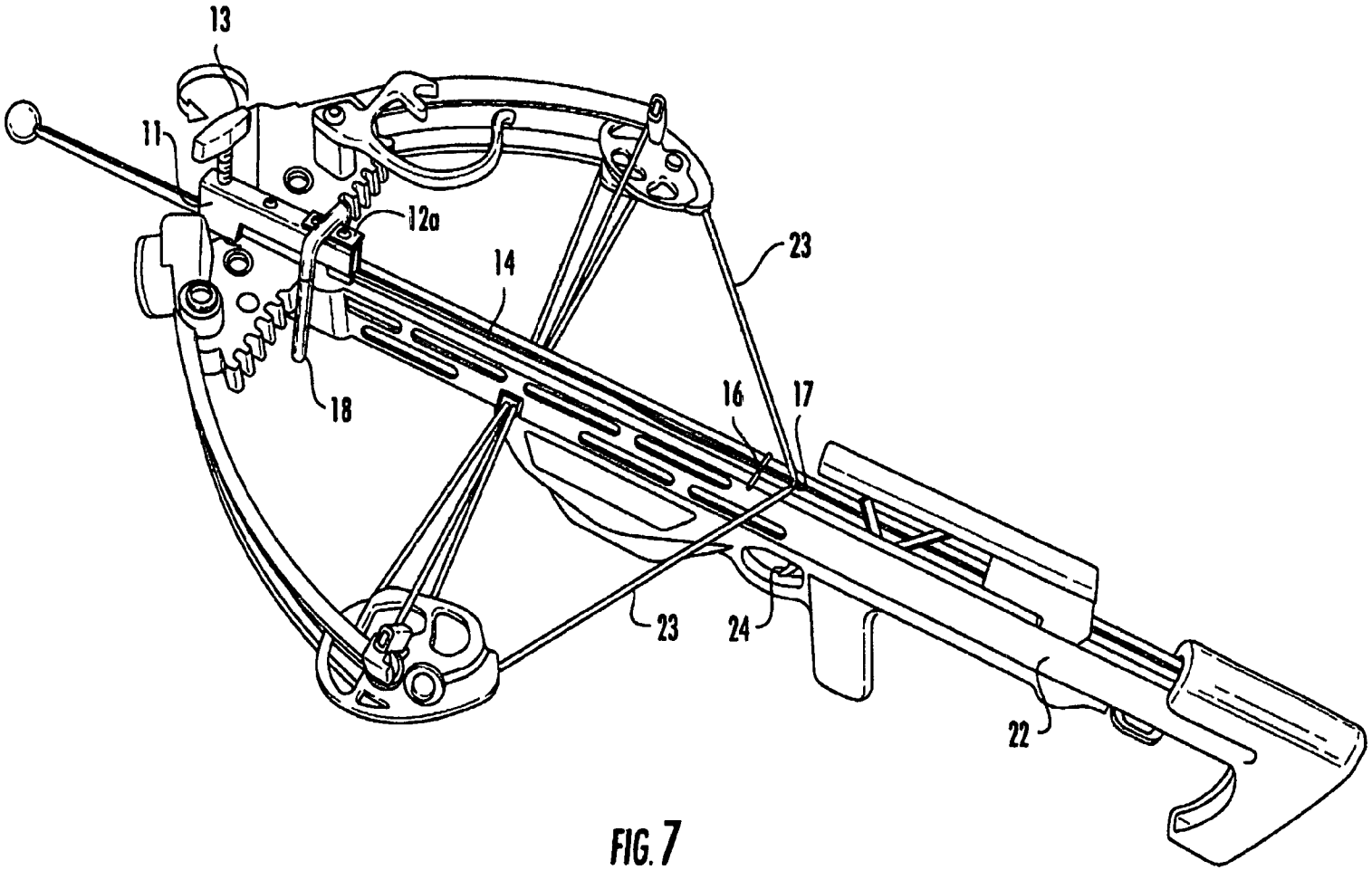
FIG. 7; is a perspective view of the apparatus shown in FIG. 1 in the process of de-cocking the crossbow shown in FIG. 6.
Figure 8:
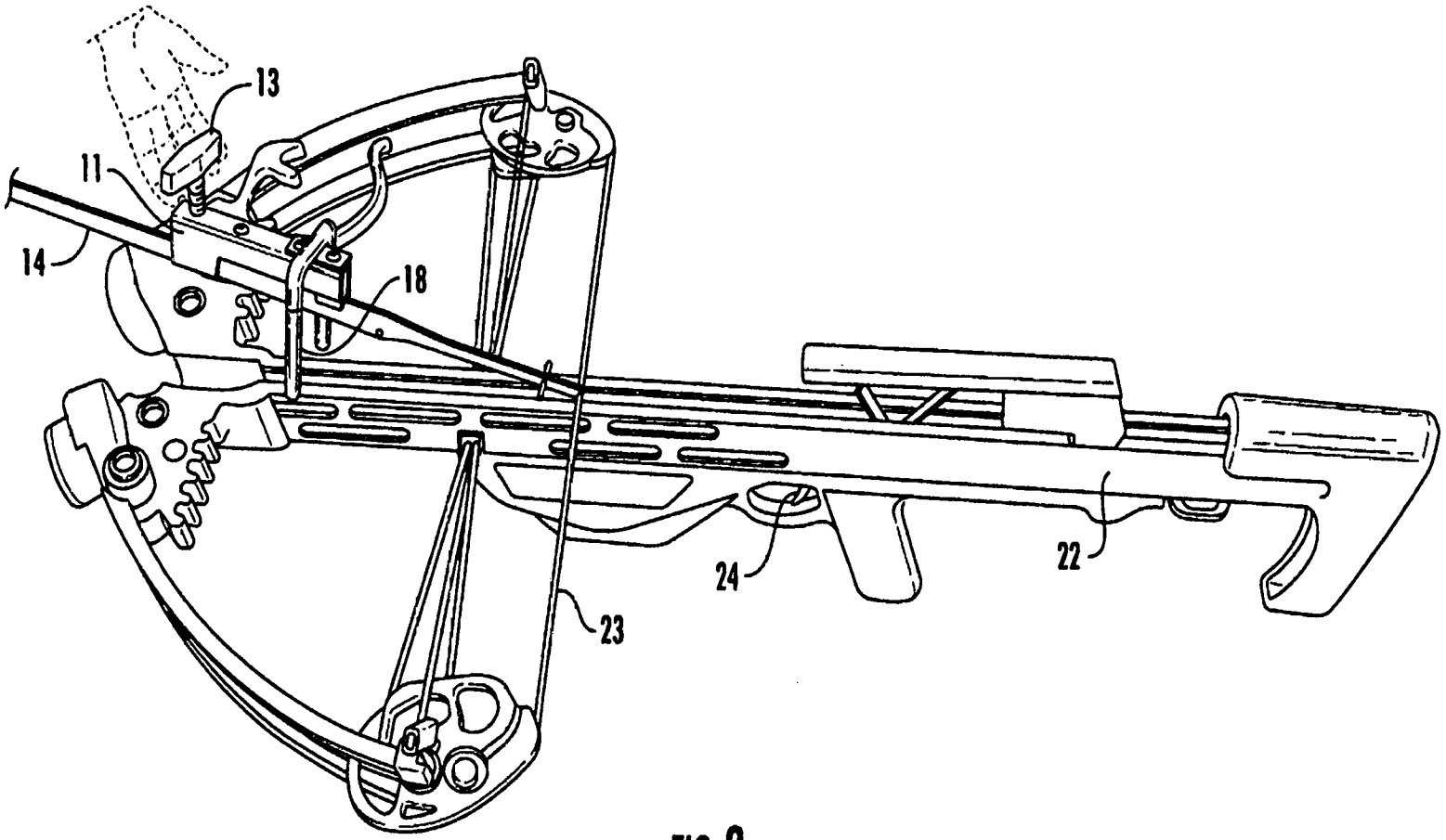
FIG. 8 is a perspective view of the apparatus shown in FIG. 1 being removed from the crossbow shown in FIG. 6 after de-cocking the crossbow.

Referring now to FIG. 6, therein is shown a perspective view of a cocked crossbow 22 and the apparatus 10 shown in FIG. 1. Crossbow 22 includes bowstring 23 and trigger 24. In use, apparatus 10 is attached to cocked crossbow 22 with the bowstring of the crossbow placed in the notch 17 of wedge 14 with the legs of U-bolt 12 resting against crossbow 22 as shown in FIG. 7. Threaded stud 13*a* of handle 13 is screwed into body 11 to contact wedge 14. The safety of crossbow 22 is switched off and trigger 24 pulled to release the bowstring 23 of crossbow 22. Bowstring 23 of crossbow 22 trys to pass wedge 14 through the channel in body 11 but passage of wedge 14 through the channel is stopped by contact with threaded stud 13*a* of handle 13. Then, as shown in FIG. 7, handle 13 is unscrewed to permit the controlled passage of wedge 14 through the channel in body 11. When crossbow 22 has been fully de-cocked, apparatus 10 is removed from crossbow 22 as shown in FIG. 8.

Referring now to FIG. 12, therein is shown an perspective view of a preferred apparatus 25 of the instant invention for de-cocking a reverse draw crossbow, the apparatus 25 being the same in many respects to the apparatus 10 shown in FIG. 1. Elements that are the same in apparatus 25 as apparatus 10 have the same reference numerals as the apparatus 10 shown in FIG. 1. The different element in apparatus 25 is hook 26 welded to plate 12*a*. Hook 26 has hook ends 27 and 28. Apparatus 25 is attached to a reverse draw crossbow by placing a pin transversely through the barrel of the crossbow to engage with the hook ends 27 and 28.

Figure 9:
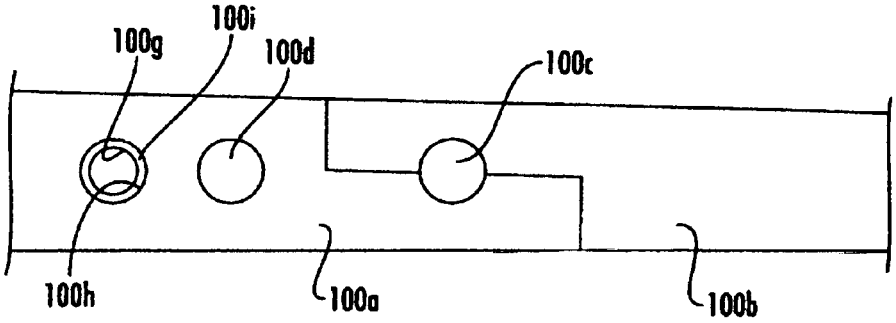
FIG. 9 is a side view of the joint of a jointed wedge of the instant invention.
Figure 10:
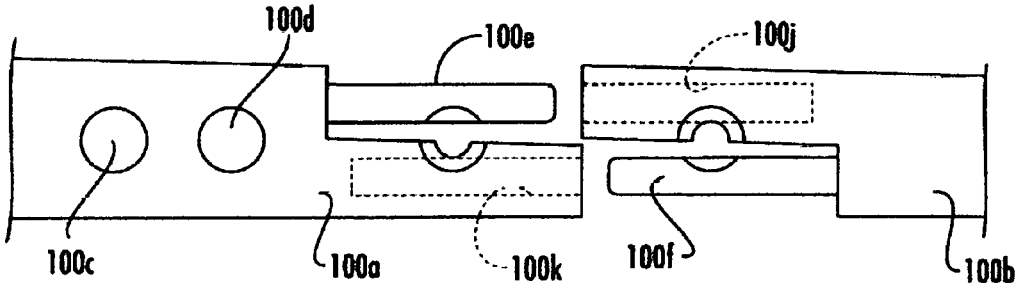
FIG. 10 is a side view of the wedge shown in FIG. 9 un-jointed.

In a highly preferred embodiment, the wedge of the instant invention is jointed. Referring now to FIG. 9, therein is shown a side view of the central portion of such a jointed wedge. Ball end portion 100*b* of the wedge is held to notch portion 100*a* of wedge by button magnet 100*c*. Aperture 100*g* through wedge portion 100*a* is coincident with bore 100*h*, leaving ledge 100*i* in wedge portion 100*a*. Button magnet 100*d* is provided as a spare. When a button magnet is placed in bore 100*h*, the magnet rests on ledge 100*i*, which button magnet can be removed by finger pressure from the back side of wedge portion 100*a*. Referring now to FIG. 10, therein is shown notch end portion 100*a* separated from ball end portion 100*b*. Pin 100*e* is dimensioned to fit into bore 100*j*. Pin 100*f* is dimensioned to fit into bore 100*k*. In FIG. 10, button magnet 100*c* is shown placed in bore 100*h* of notch end portion 100*a*.

Figure 11:
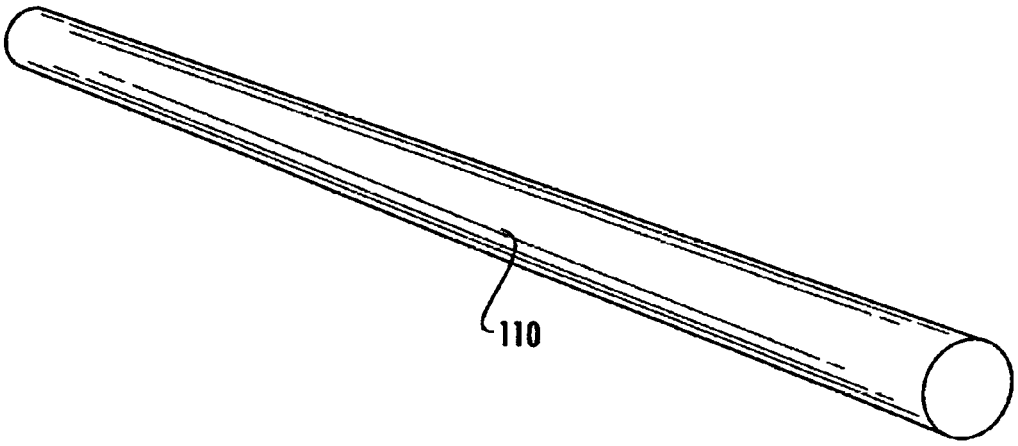
FIG. 11 is a perspective view of an the central portion of an alternative wedge of the instant invention in the form of a tapered rod.

The term "wedge" used herein is intended to be defined broadly as an elongated body comprising opposed sides that taper or incline from one end thereof to the other end thereof and thus the term "wedge" includes, for example, a tapered rod. FIG. 11 shows the central portion of a wedge of the instant invention in the form of tapered rod 110. Wedge 14 of FIG. 1 is in example of a wedge having opposed inclined planar surfaces from accessory hole 14*a* to ball 15 and parallel planar surfaces perpendicular to the opposed inclined planar surfaces. Although not preferred, wedge 14 could have had rounded opposed inclined surfaces from accessory hole 14*a* to ball 15 and parallel planar surfaces perpendicular to the opposed inclined rounded surfaces.

In conclusion, while the instant invention has been described above according to its preferred embodiment, it can be modified within the spirit and scope of this disclosure. This application is therefore intended to cover any variations, uses, or adaptations of the instant invention using the general principles disclosed herein. Further, the instant application is intended to cover such departures from the present disclosure as come within the known or customary practice in the art to which this invention pertains.

What is claimed is:

1. Apparatus for de-cocking a crossbow, the crossbow having a bowstring and a trigger comprising: (a) a first body adapted to attach to a crossbow, the first body comprising a channel therethrough, the first body also comprising a threaded bore therethrough, the threaded bore intersecting with the channel; (b) an elongated second body having opposed sides that incline once from one end thereof toward the other end thereof, the elongated second body having a notch at the other end thereof, the elongated second body adapted to slide through said channel, (c) a threaded stud having a distal end so that when said elongated second body is slid through said channel and said threaded stud is threaded into said threaded bore, the distal end of said stud can contact said elongated second body and halt further travel of said elongated second body through said first body, so that when the first body is attached to a cocked crossbow with the bowstring of the crossbow positioned in the notch of the elongated second body with the distal end of the stud contacting the elongated second body, the trigger of the crossbow can then be pulled to release the bowstring against the elongated second body and then the threaded stud can be unscrewed to permit the elongated second body to controllably slide further through said channel to de-cock the crossbow.

2. The apparatus of claim 1, wherein the first body comprises spaced apart parallel extensions from the first body so that when the trigger of a crossbow is pulled to release the bowstring against the elongated second body, the parallel spaced apart parallel extensions from the first body attach the first body to the crossbow.

3. The apparatus of claim 2, wherein the elongated second body comprises opposed inclined planar surfaces.

4. The apparatus of claim 3, wherein the elongated second body is comprised of jointed sections.

5. The apparatus of claim 2, wherein the elongated second body comprises opposed inclined curved surfaces.

6. The apparatus of claim 5, wherein the elongated second body comprises a tapered rod.

7. The apparatus of claim 1, wherein the first body comprises spaced apart hook extensions from the first body so that when the trigger of a crossbow is pulled to release the bowstring against the elongated second body, the parallel spaced apart parallel hook extensions from the first body attach the first body to the crossbow.

8. The apparatus of claim 7, wherein the elongated second body comprises opposed inclined planar surfaces.

9. The apparatus of claim 8, wherein the elongated second body is comprised of jointed sections.

10. The apparatus of claim 7, wherein the elongated second body comprises opposed inclined curved surfaces.

11. The apparatus of claim 10, wherein the elongated second body comprises a tapered rod.

12. The apparatus of claim 1, wherein the elongated second body comprises opposed inclined planar surfaces.

13. The apparatus of claim 12, wherein the elongated second body is comprised of jointed sections.

14. The apparatus of claim 1, wherein the elongated second body comprises opposed inclined curved surfaces.

15. The apparatus of claim 14, wherein the elongated second body comprises a tapered rod.

16. A method of de-cocking a cocked crossbow, the crossbow having a bowstring, the method comprising the use of an elongated second body having opposed sides that incline once from one end thereof toward the other end thereof, the elongated second body having a notch at the other end thereof, comprising: (a) engaging the bowstring of a crossbow with a said notch of the elongated second body, the elongated second body being engaged in a channel of a first body, the first body comprising a threaded bore intersecting with said channel, a threaded stud being screwed into said threaded bore so that the end of said stud contacts said elongated second body in said channel; (b) attaching said first body to said cocked crossbow; (c) releasing said bowstring against said notch; and (d) unscrewing said stud to permit said elongated second body to controllably slide further through said channel to de-cock said crossbow.

* * * * *